US011782386B2

(12) United States Patent
Christan et al.

(10) Patent No.: US 11,782,386 B2
(45) Date of Patent: Oct. 10, 2023

(54) TIMEPIECE BARREL WITH A TWISTED ARBOUR

(71) Applicant: ETA SA MANUFACTURE HORLOGÈRE SUISSE, Grenchen (CH)

(72) Inventors: Julien Christan, Bienne (CH); Laurent Kaelin, Sonvilier (CH)

(73) Assignee: ETA SA MANUFACTURE HORLOGÈRE SUISSE, Grenchen (CH)

( * ) Notice: Subject to any disclaimer, the term of this patent is extended or adjusted under 35 U.S.C. 154(b) by 313 days.

(21) Appl. No.: 17/166,545

(22) Filed: Feb. 3, 2021

(65) Prior Publication Data

US 2021/0263471 A1 Aug. 26, 2021

(30) Foreign Application Priority Data

Feb. 25, 2020 (EP) ..... 20159421

(51) Int. Cl.
*G04B 1/16* (2006.01)

(52) U.S. Cl.
CPC ..... *G04B 1/16* (2013.01)

(58) Field of Classification Search
CPC ..... G04B 1/16; G04B 1/18
See application file for complete search history.

(56) References Cited

U.S. PATENT DOCUMENTS

2010/0149928 A1* 6/2010 Reynard ..... G04B 1/16 368/206
2013/0058681 A1* 3/2013 Lee ..... G03G 15/757 399/167
2015/0309475 A1* 10/2015 Kaelin ..... G04B 1/145 368/142

FOREIGN PATENT DOCUMENTS

| | | | |
|---|---|---|---|
| CH | 713 951 | A2 | 1/2019 |
| EP | 2 196 866 | A2 | 6/2010 |
| EP | 2 657 794 | A1 | 10/2013 |
| JP | 2005-156344 | A | 6/2005 |

OTHER PUBLICATIONS

European Search Report for EP 20 15 9421 dated Jul. 15, 2020.

* cited by examiner

*Primary Examiner* — Sean Kayes
*Assistant Examiner* — Kevin Andrew Johnston
(74) *Attorney, Agent, or Firm* — Sughrue Mion, PLLC

(57) ABSTRACT

A twisted arbour barrel (1), including a barrel drum (2) provided with a housing, a spring arranged in the housing of the barrel drum (2), an arbour (4) at least partially passing through the housing, the spring being compressed by rotation of the arbour in a first direction of rotation (12), the arbour (4) being provided with a protruding end (9) of the drum (2), a ratchet (3) arranged on the drum (2), the ratchet (3) being configured to allow the rotation of the arbour (4) in the first direction of rotation (12), the protruding end (9) passing through the ratchet (3) through an opening (14) cooperating by interlocking with the protruding end (9), the protruding end (9) of the arbour (4) having a twisted shape around its axis.

13 Claims, 2 Drawing Sheets

TIMEPIECE BARREL WITH A TWISTED ARBOUR

CROSS REFERENCE TO RELATED APPLICATIONS

This application is a Non-Provisional Application, claiming priority based on European Patent Application No. 20159421.5 filed Feb. 25, 2020.

FIELD OF THE INVENTION

The invention relates to a twisted arbour barrel for a mechanical horological movement.

The invention also relates to a horological movement including at least one such twisted arbour barrel.

The invention also relates to a timepiece comprising such a horological movement.

The invention relates to the field of watchmaking, and more particularly to the field of energy storage barrels, for power supplying a movement, a chime, or else another functionality of a timepiece.

BACKGROUND OF THE INVENTION

In conventional barrel architecture, a ratchet is axially mounted on one end of a barrel arbour, said end being protruding from the barrel drum. The protruding end has a square section, cooperating complementarily by interlocking within a housing of the same section provided in the centre of said ratchet, in order to drive it.

As such, the opposite end of the barrel arbour is axially mounted rotationally free relative to a barrel drum. The latter internally receives a barrel spring, in the shape of an elastically shaped blade, one end of which is blocked against a clearance provided in the inner wall of said drum, while the opposite end of said spring is fastened on the arbour, by means of a hook, in particular arranged on a core integral with said arbour. Thus, by compressing the spring within the drum, its elasticity imparts a rotational movement to said arbour relative to the casing of the drum, which drives the ratchet externally to said barrel drum.

It will be noted that the ratchet is blocked on the arbour by bearingly screwing on a shoulder formed projecting on said arbour, beyond the square section of the protruding end. Further on, an axial screw is screwed into a hole complementarily tapped within said protruding end.

In this context, during maintenance of the movement of a timepiece requiring intervention on the barrel, such as for example washing or a change, it is necessary to dismount the barrel. For this purpose, a frame must be removed to access the ratchet, then the ratchet must be withdrawn to access the barrel. This dismounting operation is carried out while the spring of the barrel is still under tension, the ratchet in turn being blocked by a pawl. First, the rotation of the ratchet is released by retracting the pawl, allowing the spring to be relaxed. Once the spring is fully relaxed, said screw is unscrewed from the arbour, to extract the ratchet and thus access the barrel.

This type of screw mounting firstly imposes a dimensioning constraint on the diameter of the arbour, the protruding end of which is intended to receive the screw. This dimensioning impacts the space available in the drum for the spring and limits the number of windings of said spring, namely the power reserve of the timepiece.

Moreover, in order to reduce the number of components and the mounting and dismounting operations, it is considered to dispense with the holding of the ratchet by screwing, by eliminating the screw and the tapping of the arbour, in particular allowing the diameter of the latter to be reduced. Such an elimination allows the timepiece to be made more compact, while increasing its power reserve.

However, by eliminating the screw which holds the ratchet, when it is subjected to the torque of the compressed spring within the barrel, the ratchet is liable to jump when the frame is removed, which is now the only component to hold it on the protruding end of the arbour. The sudden expulsion of the ratchet risks surprising or even injuring the watchmaker, as well as damaging said ratchet or other components, or even losing it.

SUMMARY OF THE INVENTION

The invention aims at keeping a ratchet locked on an arbour of a barrel, dispensing with fastening by screwing, while avoiding the risk of the ratchet springing out by the spring.

To this end, the invention relates to a twisted arbour barrel, comprising at least:

a barrel drum provided with a housing, a spring arranged in the housing of the barrel drum, an arbour at least partially passing through the housing, said spring being compressed by rotation of said arbour in a first direction of rotation, the arbour being provided with a protruding end of said drum, a ratchet arranged on the drum, the ratchet being configured to allow the rotation of the arbour in the first direction of rotation, the protruding end passing through the ratchet through an opening cooperating by interlocking with the protruding end.

The barrel is remarkable in that said protruding end of the arbour has a shape twisted around its axis.

Thus, the invention considers a protruding end of said arbour which is provided twisted or twined, imposing a rotation in a direction of the ratchet when it is introduced onto said arbour from the distal point of the protruding end to the locking position against the core of said arbour, and in the opposite direction of rotation during its extraction.

Therefore, as long as the barrel is loaded, the torque provided by the compression of the barrel spring is sufficient to prevent the ratchet from rotating relative to said arbour in said opposite direction of extraction, and consequently also prevents it from winding along the square section of the twisted arbour.

Furthermore, since no screws are used, the arbour can be narrower. The invention allows the diameter of the core to be reduced, thus allowing a longer spring to be housed in the barrel drum, increasing the number of coils around the core and thus the power reserve of the barrel.

In addition, the arbour according to the invention allows time to be saved, since it is no longer necessary to unscrew a screw to remove the ratchet. The ratchet can be removed directly without any prior step, except the one concerning the ratchet.

Further forward, the protruding end of the arbour is twisted in the direction opposite to the torque applied to said arbour by the compression spring. In other words, if the torque is exerted in the clockwise direction on the core of the arbour, then the protruding end of said arbour is twisted in the opposite direction, from the core towards said distal end, and vice versa.

According to an advantageous embodiment, said protruding end is of polygonal section, the opening of the ratchet having a corresponding shape.

According to an advantageous embodiment, said protruding end has a square section.

According to an advantageous embodiment, the edges of said protruding end are chamfered.

According to an advantageous embodiment, said protruding end comprises a distal face angularly offset relative to its base on the barrel.

According to an advantageous embodiment, the offset is at least 30 degrees.

According to an advantageous embodiment, said barrel comprises a core surrounding said arbour, the core being arranged in the housing.

According to an advantageous embodiment, the spring is held in the housing, on the one hand, at an internal peripheral face of the barrel, and on the other hand, at the core of the arbour.

According to an advantageous embodiment, the arbour passes through the housing and is mounted rotationally free relative to said barrel drum.

According to an advantageous embodiment, said barrel comprises a pawl cooperating directly or indirectly with teeth arranged on the outer peripheral face of the drum, so as to prevent it from rotating in the direction opposite to the first direction.

The invention also relates to a horological movement comprising such a barrel.

The invention also relates to a timepiece comprising such a horological movement.

BRIEF DESCRIPTION OF THE FIGURES

The invention will be described in more detail below using the appended drawings, given by way of non-limiting examples, wherein.

DETAILED DESCRIPTION OF THE INVENTION

Figure 1:
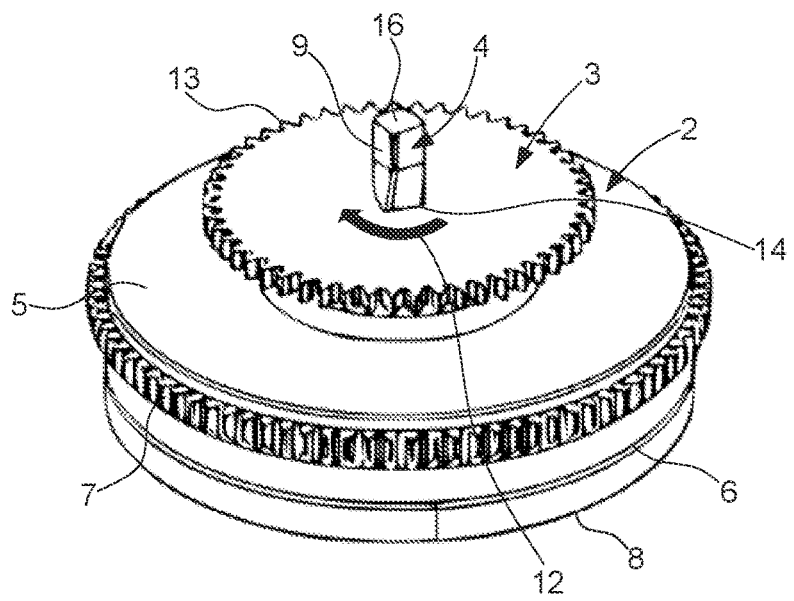
FIG. 1 schematically shows a perspective view of a barrel according to one embodiment of the invention, the ratchet being in a first position.
Figure 2:
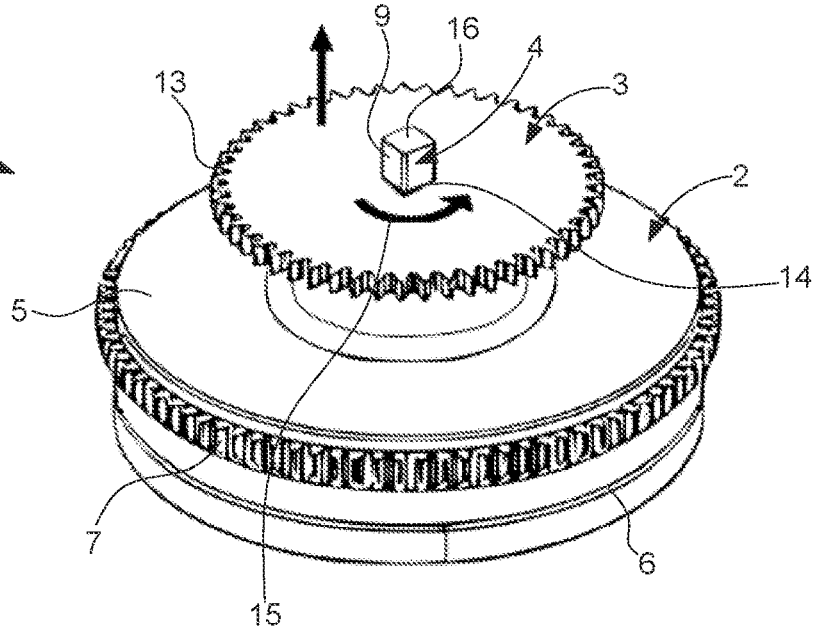
FIG. 2 schematically shows a perspective view of a barrel according to one embodiment of the invention, the ratchet being in a second position.

The present invention relates to a barrel 1 with a twisted arbour 4, as shown in FIGS. 1 and 2.

The barrel 1 comprises a cylindrical-shaped barrel drum 2. The drum 2 comprises an upper face 5 and a lower face 8 in the shape of discs, as well as a rounded peripheral face 6. The drum 2 is provided with a housing delimited by the upper 5, lower 8 and peripheral 6 faces.

The peripheral face 6 of the drum 2 is provided with gear teeth 7 at the junction of the upper face 5. These teeth 7 allow the torque of the spring to be transmitted to the rest of the movement, in particular to actuate the movement of the hands.

The barrel 1 includes an arbour 4 passing through the housing. The arbour 4 extends around a main longitudinal axis about which it can rotate. The arbour 4 is provided with a protruding end 9 of said drum 2.

The barrel 1 comprises a spring, not shown in the figures, the spring being arranged in the housing of the barrel drum 2. The spring is spiral shaped. The spring is held in the housing, on the one hand, at the internal peripheral face 6 of the barrel, and on the other hand, at the arbour 4. The spring is compressed by rotation of said arbour 4 in a first direction of rotation 12.

The barrel 1 is provided with a ratchet 3 arranged on the drum 2. In the operating position, as shown in FIG. 2, the ratchet 3 rests on the upper face 5 of the barrel drum 2. The major part of the protruding end 9 projects beyond the ratchet 3. The ratchet 3 is a flat disc provided with peripheral gear teeth 13. The ratchet 3 is configured to allow the rotation of the arbour 4 in the first direction of rotation 12. The ratchet 3 comprises an opening 14 cooperating by interlocking with the protruding end 9 of the arbour 4, the protruding end 9 passing through the ratchet 3. In one movement, the ratchet 3 is for example blocked in the other direction by a pawl, not shown in the figures. The pawl does not prevent the ratchet from rotating in the first direction 12. Thus, when the ratchet 3 is rotated, the arbour 4 rotates in the first direction 12 and compresses the spiral spring inside the drum housing 3. But the ratchet 3 is blocked in the other direction so that the spring remains compressed. Thus, the force exerted by the spring rotates the barrel 2 to actuate the mechanism of the horological movement, and not the arbour 4.

According to the invention, said protruding end 9 of the arbour 4 has a shape twisted around its axis. The protruding end 9 is twisted in the direction opposite to said first direction 12 relative to the drum 2. Said protruding end 9 is of polygonal section, the opening 14 of the ratchet 3 having a corresponding shape. Said protruding end 9 is of square section in the figures. Preferably, the edges of said protruding end 9 are chamfered. Said protruding end 9 comprises a distal face 16 angularly offset relative to its base at the height of the barrel 1. The offset is preferably at least 30 degrees, or even 45 degrees.

To remove the ratchet 3, for example during maintenance of the movement, the ratchet 3 is wound along the protruding end 9 by rotating it by an angle corresponding to that of the twist of the arbour 4. For this purpose, the ratchet 3 rotates in the direction 15 of the twist of the protruding end 9. Thus, the position of the opening 14 always corresponds to the shape of the section of the protruding end 9, the ratchet 3 being able to slide along the protruding end 9.

Figure 3:
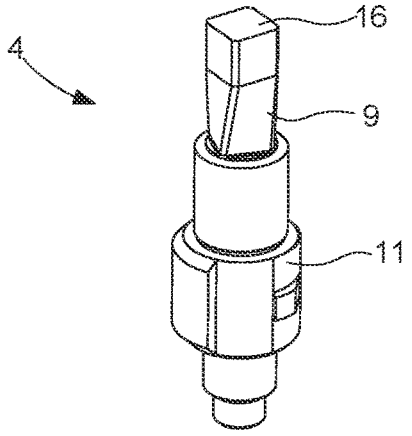
FIG. 3 schematically shows a perspective view of an arbour of a barrel according to one embodiment of the invention.

FIG. 3 shows the arbour 4 provided with the protruding end 9 and the upper face 16. The arbour 4 further comprises a core 11 surrounding said arbour, the core 11 being arranged in the housing. The spring is held at the core 11 of the arbour 4.

Thus, in the barrel 1, the spring applies a force to the arbour 4 through the core 11, the arbour 4 transmitting the force to the ratchet 3, which is blocked by the pawl. Thus, the ratchet 3 does not risk sliding along the protruding end, because the force is applied in the direction 12 opposite to the direction 15 of the twist.

The present invention also relates to a horological movement 10 comprising a barrel as described above.

Figure 4:
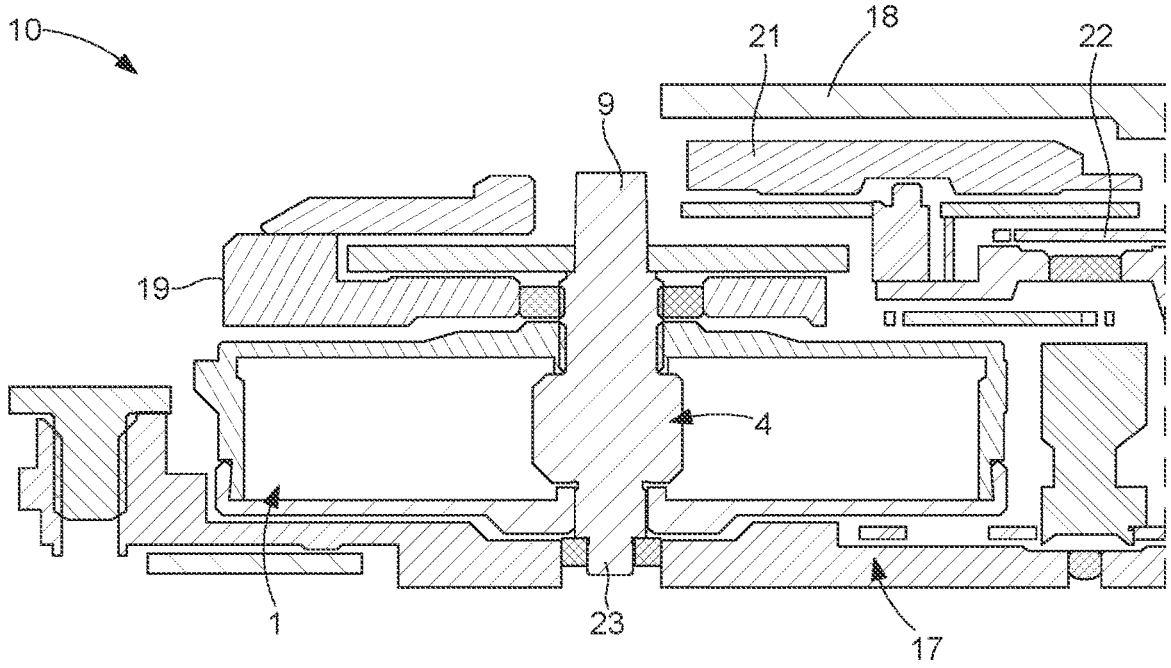
FIG. 4 schematically shows a sectional view of part of an automatic winding horological movement provided with a barrel according to the invention.

FIG. 4 shows a part 10 of an automatic winding movement comprising the barrel 1 according to the invention. This part 10 comprises a plate 17 of the movement, an oscillating mass 18, a barrel bridge 19, a bridge 21 of the automatic winding system, gears 22 of the hand display system of the timepiece. The plate 17 and the two bridges 19, 21 are substantially parallel. From bottom to top, there is the plate 17, the barrel bridge 19, the bridge 21 of the automatic winding system and the oscillating mass 18. The gears 22 are disposed next to the barrel bridge 19, under the bridge 21 of the automatic winding system.

The barrel 1 is mounted between the plate 17 and the barrel bridge 19. To this end, the protruding end 9 of the arbour 4 passes through the barrel bridge 19 and the ratchet 3, the ratchet 3 being arranged on the barrel bridge 19, below the bridge of the automatic winding system 21. The other free end 23 of the arbour is assembled to the plate 17 while being rotationally free about its axis relative to the latter.

Figure 5:
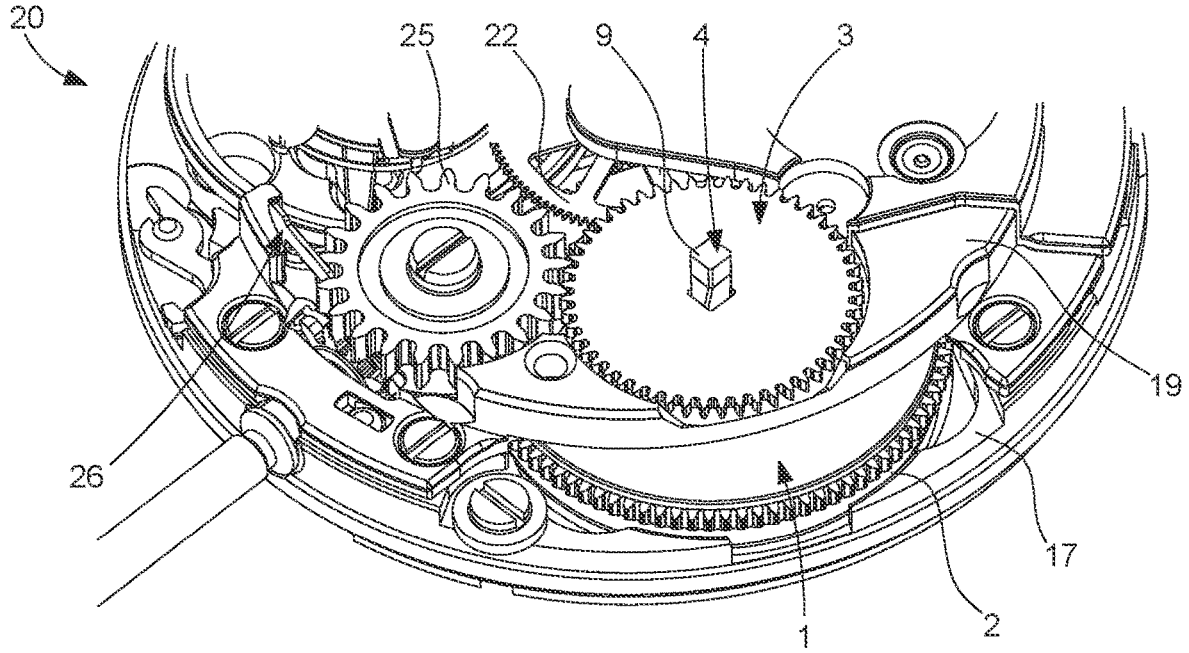
FIG. 5 shows schematically a perspective view of part of a manual winding horological movement provided with a barrel according to the invention.

In the manual winding movement of FIG. 5, the movement 20 is similar, but does not have an automatic winding system. The ratchet 3 is engaged with a crown wheel 25, which can be actuated from the outer crown of the timepiece, the crown not being shown in the figures. Thus, by actuating the crown, the crown wheel 25 meshes with the ratchet 3, which rotates the arbour of the barrel 4 to constrain the spring inside the drum 2, and to wind the spring. In this embodiment, the ratchet blocking pawl 26 is arranged on the crown wheel 25 instead of the ratchet 3 directly. The pawl 26 allows the crown wheel 25 to be rotated in one direction only, the direction allowing the spring to be wound.

The invention also relates to a timepiece, not shown in the figures, comprising such a horological movement.

The invention claimed is:

1. A twisted arbour barrel comprising:

a barrel drum provided with a housing, a spring arranged in the housing of the barrel drum, an arbour at least partially passing through the housing, said spring being compressed by rotation of said arbour in a first direction of rotation, the arbour being provided with a protruding end, a ratchet arranged on the drum, the ratchet being configured to allow the rotation of the arbour in the first direction of rotation, the protruding end passing through the ratchet through an opening cooperating by interlocking with the protruding end, wherein said protruding end has a shape twisted around its axis.

2. The barrel according to claim 1, wherein the protruding end is twisted in the direction opposite to said first direction relative to the drum.

3. The barrel according to claim 1, wherein said protruding end is of polygonal section, the opening of the ratchet having a corresponding shape.

4. The barrel according to claim 3, wherein said protruding end is of square section.

5. The barrel according to claim 1, wherein edges of said protruding end are chamfered.

6. The barrel according to claim 1, wherein said protruding end comprises a distal face angularly offset relative to its base on the barrel.

7. The barrel according to claim 6, wherein the offset is at least 30 degrees.

8. The barrel according to claim 1, further comprising a core surrounding said arbour, the core being arranged in the housing.

9. The barrel according to claim 8, wherein the spring is held in the housing, on the one hand, at an internal peripheral face of the barrel, and on the other hand, at the core.

10. The barrel according to claim 1, wherein the arbour passes through the housing and is mounted rotationally free relative to said barrel drum.

11. The barrel according to claim 1, further comprising a pawl cooperating directly or indirectly with teeth arranged on an outer peripheral face of the drum, so as to prevent the drum from rotating in the direction opposite to the first direction.

12. A horological movement comprising the barrel according to claim 1.

13. A timepiece comprising the horological movement according to claim 12.

* * * * *